US005483771A

United States Patent [19]

Herbst

[11] Patent Number: 5,483,771

[45] Date of Patent: Jan. 16, 1996

[54] DOOR HINGE AND MOUNT

[76] Inventor: Walter Herbst, 86 Salem La., Evanston, Ill. 60203

[21] Appl. No.: 313,002

[22] Filed: Sep. 27, 1994

[51] Int. Cl.[6] ..... E06B 1/04

[52] U.S. Cl. ..... 49/504; 49/381; 52/204.1

[58] Field of Search ..... 49/504, 381; 52/204.1

[56] References Cited

U.S. PATENT DOCUMENTS

| | | | |
|---|---|---|---|
| 2,660,272 | 11/1953 | Walterman et al. | 49/504 |
| 3,354,586 | 11/1967 | Besten | 49/504 |
| 3,724,135 | 4/1973 | Heliotes | 49/504 |

*Primary Examiner*—Carl D. Friedman
*Assistant Examiner*—W. Glenn Edwards
*Attorney, Agent, or Firm*—Jack E. Dominik

[57] ABSTRACT

A modification of the Z-bar mount portion of the door hinge mount to raise the hinge mount flat portion at its upper portion where the curvilinear bridge piece is located between the insulating mount portion and the hinge portion to extend the extrusion to form a cover stop around the hinge to a point essentially flush with a plane perpendicular to the door lateral edge and overlying the hinge is disclosed. This produces a rounded pleasing cover stop which masks the hinge from the exterior. Also, it inhibits the door from opening at an angle more than 90° from the closed position, which with the pneumatic closer and safety chain produces a three-way redundant system to resist the door blowing off its mount or hinge. In addition, it further blocks the access of strong winds from penetrating the areas between the knuckles of the hinge and the space between the door and mount.

6 Claims, 2 Drawing Sheets

DOOR HINGE AND MOUNT

FIELD OF THE INVENTION

The present invention relates to door hinges and mounts for the same, ideally employed in the environment of a combination storm and screen self-storing door which is exemplified in U.S. Pat. No. 4,311,183.

SUMMARY OF THE PRIOR ART

The subject matter of molded doors used as storm doors in which the window and screen are self-storing is well exemplified in U.S. Pat. No. 4,311,183. From a standpoint of aesthetics as well as insulation and limiting the motion of the door around the hinge the elongate piano hinge shown in U.S. Pat. No. 4,311,183 and more particularly as shown in recently issued U.S. Pat. No. 5,327,684 still remains a detriment to the overall appearance and function of the door. From an architectural standpoint door hinges are normally masked by the hanging of the door. In addition, air leakage at the hinge portion of the door can be blocked by heavy duty weather striping which is more difficult to apply in the environment of the molded doors of the prior art just identified.

SUMMARY OF THE INVENTION

The present invention is directed to a modification of the Z-bar door hinge mount to raise the hinge mount flat portion at its upper portion where the curvilinear bridge piece is located between the insulating mount portion and the hinge portion to extend the extrusion to form a cover stop around the hinge to a point essentially flush with a plane perpendicular to the door lateral edge and overlying the hinge. This produces a rounded pleasing cover stop which masks the hinge from the exterior. Also, it inhibits the door from opening at an angle more than 90° from the closed position, which with the pneumatic closer and safety chain produces a three-way redundant system to resist the door blowing off its mount or hinge. In addition, it further blocks the access of strong winds from penetrating the areas between the knuckles of the hinge and the space between the door and mount.

In view of the foregoing it is a principal object of the present invention to modify the hinge mount of a door where the hinge is essentially an endless piano-like hinge to mask the same and upgrade the aesthetics of the door in place.

Another object of the present invention is to provide a door hinge mount which inhibits the door from opening more than 90° from its closed position.

Yet another object of the present invention is to shield an endless door hinge at the portion where it is mounted to the building structure to reduce the ingress of wind, the formation of ice, and the like.

Finally, yet a further object of the present invention is to achieve all of the advantages and objects set forth above with a minimal cost increase, namely, only the cost of the metal curvilinear portion which is added to the pre-existing Z-bar structure.

BRIEF DESCRIPTION OF THE ILLUSTRATIVE DRAWINGS

Further object and advantages of the present invention will become apparent as the following description of an illustrative embodiment proceeds, taken in conjunction with the accompanying drawings, in which.

DESCRIPTION OF A PREFERRED EMBODIMENT

Figure 1:
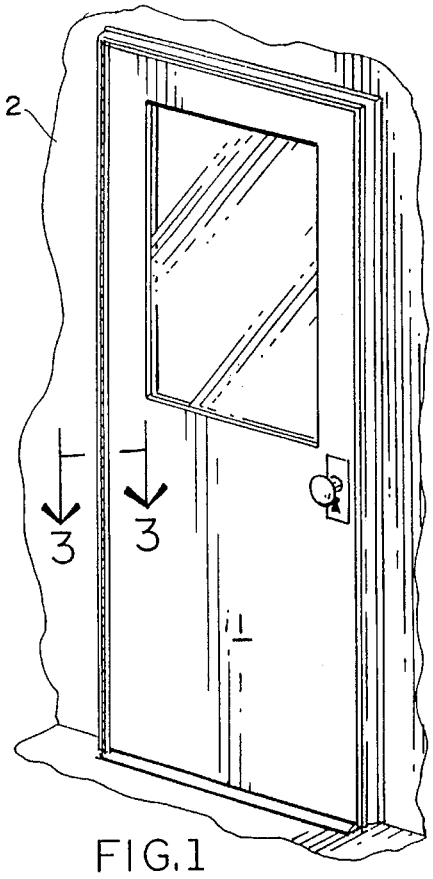
FIG. 1 is illustrative of a typical closed storm door employed utilizing the special mount illustrative of the present invention.

As shown in FIG. 1, the subject invention finds its utility in conjunction with a door, preferably a storm door 1, which is mounted within a frame 2 for the main door. The storm door 1 is supplied with the traditional pneumatic closer 4 at a position beneath the window, and with a safety chain 5 at a position above the window. Both of these serve to restrain the door against opening more than 90° when it is caught in a strong wind, or otherwise abused. It is in this environment in which the hinge mount assembly 10 is employed to secure the door 1 to the frame 2 for actuating between a closed and opened position.

Figure 2:
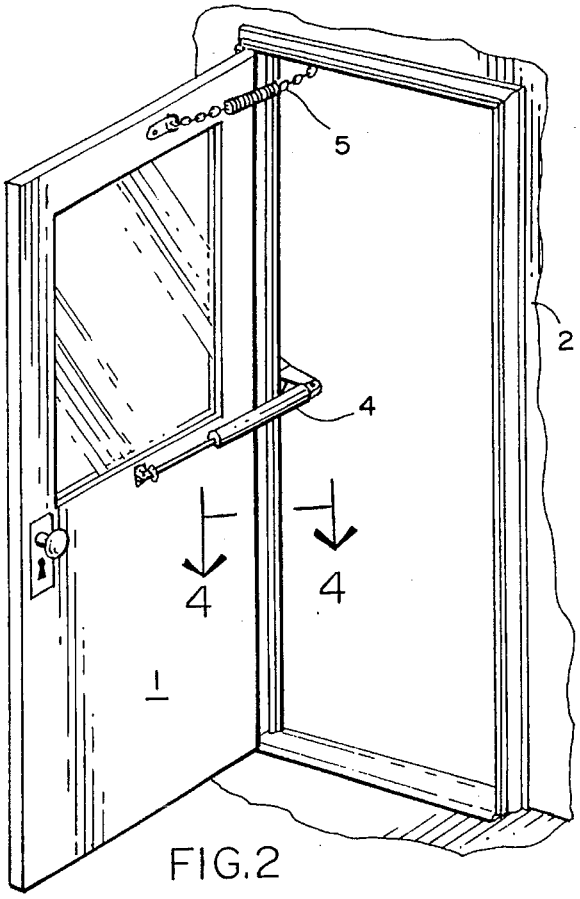
FIG. 2 is a view from substantially the same elevation as FIG. 1, but illustrating the storm door in the fully opened position.

Turning now to FIG. 2, it will be seen that the hinge and mount assembly 10 includes the hinge 11 which has a door leaf 12 and a mount leaf 14 each of which are respectively secured to the mount and to the door by means of screws or other fasteners. Once the door 1 is hung in the frame 2 normally the knuckles 15 of the hinge 11 will show on the outside, as with the prior art identified in U.S. Pat. No. 4,311,183 and U.S. Pat. No. 5,327,684.

Because the Z-bar 16, which has a Z-bar face 18 and Z-bar foot 19, terminates at the joint between the mount face and the Z-bar bridge 21 with a cover stop 20, the knuckles 15 of the hinge 11 are obscured from sight. The cover stop 20 has a cover portion 22 and a stop portion 24. The stop portion is proportioned to overly the knuckles 15 of the hinge 11 in such a fashion that when normally installed, the door will open only to a position 90° from its closed configuration as illustrated in FIG. 2.

Figure 3:
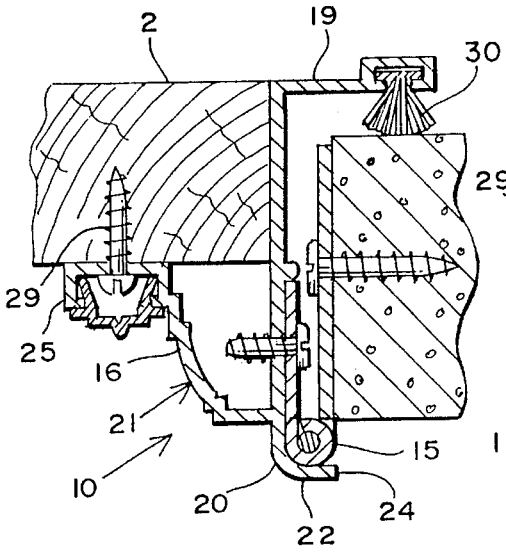
FIG. 3 is a transverse sectional view taken along section lines 3—3 of FIG. 1.
Figure 4:
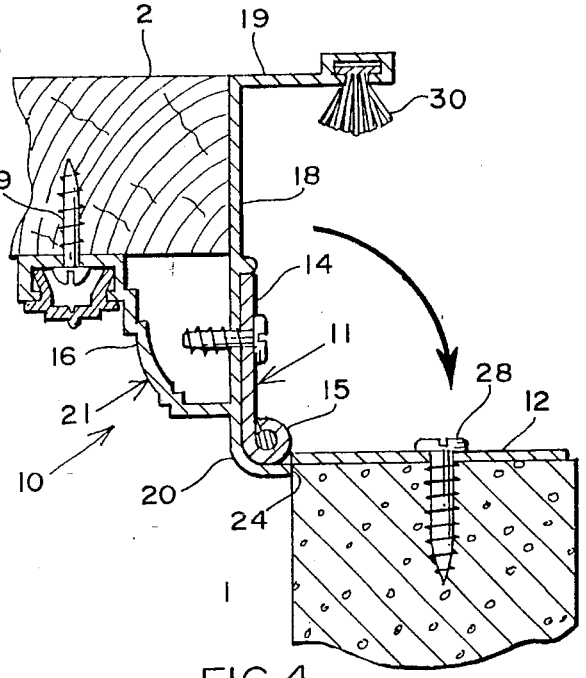
FIG. 4 is taken along section lines 4—4 of FIG. 2, identical to FIG. 3, but showing the door in the open position.
Figure 5:
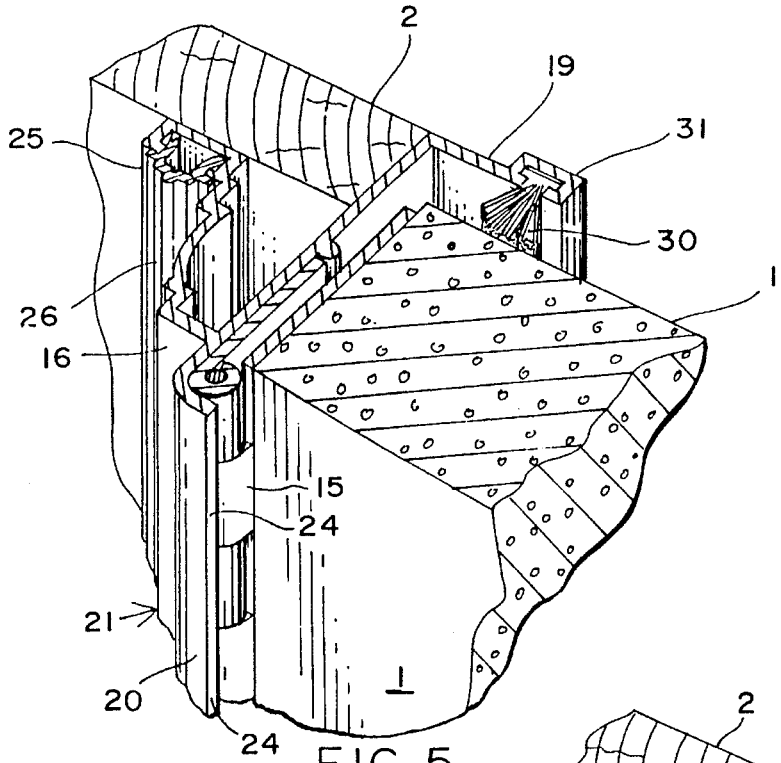
FIG. 5 is an enlarged transverse sectional view in perspective but taken essentially along section line 3—3 of FIG. 1.
Figure 6:
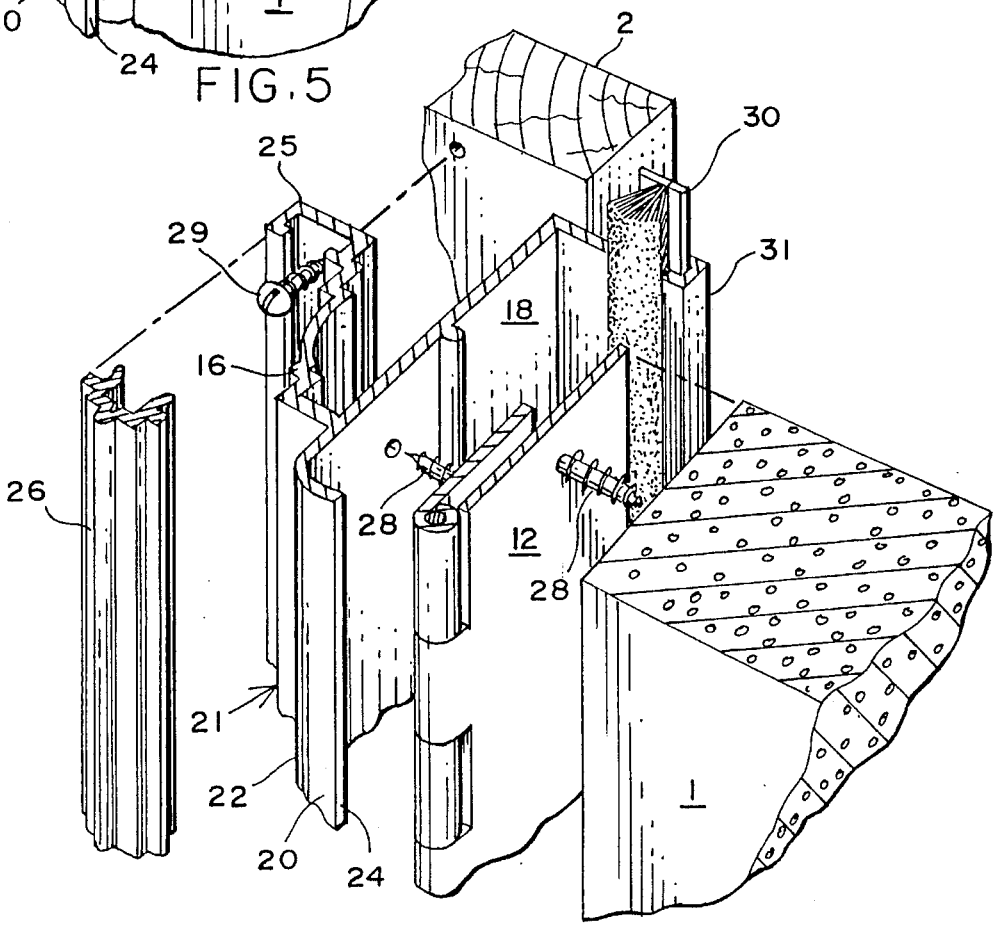
FIG. 6 is an exploded perspective view of the door, frame, and mount exploded from the configuration shown in FIG. 5.

An additional showing of the hinge mount asembly 10 appears in FIG. 3 which shows in phantom lines how the knuckles 15 of the hinge 11 are hidden from view by the cover stop 20, and more particularly its cover portion 22 and terminating in the stop portion 24. Additional details of the construction are shown in FIGS. 5 and 6. There it will be seen that the Z-bar 16 also has a frame mount 25 which has a frame mount cover 26 to secure the frame screws 29 from view. The door screws 28 are hidden within the hinged joint. The Z-bar foot 19 receives a weather shield 30 which is inserted to mount interiorly of the weather shield channel 31 on the foot 19.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A door hinge and mount for a door comprising an elongate mount having a mount face secured to an elongate hinge, said mount being characterized by a cover stop portion extending upwardly from the mount face which mounts to the door hinge and frame outwardly and centrally toward the door in a curvilinear fashion to a space essentially overlying the projected area of the hinge as mounted on the hinge mount.

2. The hinge mount of claim 1, in which the cover stop has a cover portion and a stop portion which is the lateral edge of the cover portion.

3. The hinge mount of claim 2, in which the stop portion is oriented over the hinge to stop the mounted door perpendicularly to its closed position.

4. A door hinge mount for use with an elongate endless hinge to secure the hinge to a door and to a door frame comprising, in combination, a body portion having a flat elongate face portion proportioned for engagement by the elongate hinge, a depending face portion on the mount for engagement with the frame, a bridge-like member portion of the mount extending toward the frame from the face portion of the mount terminating in a foot portion having a plurality of fastening members to secure the same to a door frame, and a curvilinear cover stop as an extension outwardly from the flat mounting portion and curving in a direction to terminate approximately in shadowing relationship to the elongate endless hinge.

5. The door hinge mount of claim 4, in which the cover stop has a curved cover portion terminating in a lateral edge stop.

6. The door hinge mount of claim 5, in which the lateral edge stop is proportioned to engage the hinged door to stop its opening at 90° from the closed position.

* * * * *